US005179996A

United States Patent [19]

Blin et al.

[11] Patent Number: 5,179,996

[45] Date of Patent: Jan. 19, 1993

[54] PROCESS AND DEVICE FOR CONTINUOUS CASTING ON A ROLL OR BETWEEN TWO ROLLS

[75] Inventors: Philippe Blin, Lorry-lés-Metz; Laurent Sosin, Fameck; Dominique Loison, Woippy, all of France

[73] Assignee: Usinor Sacilor, Puteaux, France

[21] Appl. No.: 889,428

[22] Filed: May 28, 1992

Related U.S. Application Data

[63] Continuation of Ser. No. 607,116, Nov. 2, 1990.

[30] Foreign Application Priority Data

Nov. 23, 1989 [FR] France ..... 89 15539

[51] Int. Cl.[5] ..... B22D 11/06

[52] U.S. Cl. ..... 164/428; 164/448; 164/429

[58] Field of Search ..... 164/428, 429, 442, 448, 164/479, 480

[56] References Cited

U.S. PATENT DOCUMENTS 3,844,336 10/1974 Anderson .
4,456,579 6/1984 Rao .
4,552,199 11/1985 Onoyama .
4,677,623 8/1987 Wakefield .

FOREIGN PATENT DOCUMENTS 0229031 7/1987 European Pat. Off. .
309247 3/1989 European Pat. Off. .
61-097967 11/1987 Japan .
76740 4/1988 Japan .
62-240482 3/1989 Japan .
218743 8/1989 Japan .
8702284 4/1987 World Int. Prop. O. .

*Primary Examiner*—Richard K. Seidel
*Assistant Examiner*—James Miner
*Attorney, Agent, or Firm*—Cushman, Darby & Cushman

[57] ABSTRACT

The device for casting thin metal products comprises one or two rolls (1) driven in rotation and having cooled walls, and side walls (3) defining a casting space (4). The surface of each roll is divided into at least three circumferential zones, at least one (5) of said zones having a roughness (Rz) greater than the roughness of the other zones (6). This device permits carrying out the process according to the invention in which solely certain longitudinal zones of the skins of cast metal solidified on contact with the cooled walls of the rolls are preferentially driven along.

8 Claims, 1 Drawing Sheet

PROCESS AND DEVICE FOR CONTINUOUS CASTING ON A ROLL OR BETWEEN TWO ROLLS

This is a continuation of application Ser. No. 07/607,116, filed Nov. 2, 1990.

The invention relates to the continuous casting of thin metal products, in particular steel sheets, on a roll or between two rolls.

This type of casting is known and comprises bringing molten metal into contact with a cooled moving surface. Upon contact with this cooled surface, the cast metal solidifies or freezes and is driven or drawn along by the moving surface.

One of the known problems of this type of casting is to ensure a uniform solidification of the metal in contact with the cooled surface, this problem being created by the fact that, upon contact of the molten metal with the cooled surface, the metal shrinks in solidifying, this shrinkage causing the skin of solidified metal to become locally detached from the casting surface. Consequently, in the zones where this detachment occurs, the cooling of the metal is slowed down relative to the zones where the skin remains well in contact with the cooled surface. It has been found that, on a smooth surface, these phenomena occur in a disorderly manner and thus result in irregularities both in the aspect of the surface of the cast product and in its structure which may result in defects such as surface cracks.

In order to overcome this problem and ensure a homogeneity of the solidification of the cast metal, it has already been proposed to impart to the cooled surface a certain roughness which results in a rather regular distribution, on the scale of the roughness, of the zones where the cast metal is in contact with the cooled surface, and therefore a homogeneous solidification of said metal, on the scale of the dimensions of the final product.

Arrangements of this type are disclosed in particular in the documents EP 309247 and JP 62/254953 which show casting rolls whose surface has a special roughness defined by the dimensions and the disposition of the reliefs, peaks and hollows of the roughness.

Although the use of casting surfaces having particular roughness characteristics permits obtaining products of improved quality, in particular as concerns their surface, incidents nonetheless occur in the course of the casting, such as breakthroughs or attachments of the cast metal which result not only in defects in the cast product but also in serious disturbances in the course of the casting operation itself. Such incidents usually occur for example toward the edges of the casting surfaces close to the side walls or dams which laterally retain the molten metal and define the width of the product. Indeed, these side walls are fixed and the edges of the cast product have a tendency to remain attached thereto while, remote from these side walls, the metal solidified in contact with the casting surface is driven along by the latter. There results a difference in speed between the edges and the central zone of the product which is still imperfectly solidified which may result in breakthroughs or at least in serious defects on the edges of the product.

An object of the present invention is to solve these problems, to avoid the casting incidents such as breakthroughs or attachments and to provide a product of satisfactory quality throughout its width and in particular on its edges.

To this end, the invention provides a process for casting thin metal products on a roll or between two rolls driven in rotation, in which the molten metal is made to solidify in contact with the cooled walls of said roll or said rolls in forming solid metal skins which are continuously driven along by the rotation of said roll or said rolls.

According to the invention, said process is characterized in that solely certain longitudinal zones of the solidified skins are preferentially driven along.

In one embodiment of the invention, said preferentially driven zones are located in proximity to the edges or at the edges of the cast product.

In this first embodiment, the edges of the skins in course of solidification are subjected to a particularly high driving force which prevents their attachment to the fixed lateral walls or which in any case, when an attachment is beginning to appear, ruptures the latter and thereby ensures that the quantity of attached metal does not increase and result in a breakthrough of liquid metal on the downstream side of the attachment.

It has not yet been possible to explain precisely the improvement afforded by the preferential driving of solely the edges of the solidified skins. One hypothesis is that the preferential driving of the edges, i.e. where, owing to the presence of the side walls or dams, the skins have a tendency to be retained by friction against said walls and where they moreover have a tendency to solidify more rapidly, permits avoiding the aforementioned problems of attachment and breakthroughs, while the skins solidified in the median zone of the product are subjected to lower driving forces and are not liable to undergo surface stresses produced by this force, which could have an adverse effect on the quality of the product in this median zone.

In another embodiment of the process according to the invention, said preferentially driven zones are remote from the edges of the cast product.

In this second embodiment, it is the median zone of the skins which is preferentially driven along relative to the edges. In this case, the edges of the skins in process of solidification have a certain amount of freedom to deform and, in the event of an attachment to the side walls, only these zones are disturbed since they are subjected to a longitudinal shear effect while the median zone of the product, which is uniformly driven along, is not subjected to surface stresses. It seems that, in this case, the edges of the skins have as it were an effect which absorbs the stresses produced by the friction on the side walls and which are distributed over the width of the edge zones not subjected to the preferential driving, this effect increasing with the width of these edge zones. It will of course be understood that, as these edge zones are particularly disturbed, it might be necessary to trim them when they have left the casting device.

The invention also provides a device for casting thin metal products on a roll or between two rolls, this device comprising one or two rolls driven in rotation and having cooled walls, and side walls defining a casting space with the roll or rolls.

According to the invention, this device is characterized in that the surface of said roll or rolls is divided into at least three circumferential zones, at least one of said zones having a roughness which is greater than the roughness of the other zones.

In one embodiment of the device, the surface of the rolls comprises two rough zones each located in proximity to a side wall and having a roughness greater than the roughness of a third zone located between said two rough zones.

It will be clear that this first embodiment of the device in particular permits carrying out the first embodiment of the process described hereinbefore by facilitating a preferential driving of the edges of the skins solidified on the surface of said roll or rolls.

In a second embodiment of the device, the surface of the roll comprises at least one rough zone whose roughness is greater than the roughness of the other zones, this or these rough zones being at a distance from the side walls.

It will be easily understood that this second embodiment of the device in particular permits carrying out said second embodiment of the process described hereinbefore, by facilitating a preferential driving of a median zone of the solidified skins by allowing a possible slipping of the edges of said skins.

The inventors have discovered that, apart from the beneficial aspects concerning the regularity of the solidification of the cast product, the particular characteristics concerning the roughness of the casting surfaces could participate in an improvement in the conditions of the casting operation and facilitate the production of a product cast on one roll or between two rolls, in particular by avoiding the well-known problems resulting from the contact of the metal with the fixed side walls.

Further features and advantages of the invention will be apparent from the following description, given by way of example, of several embodiments of the invention.

With reference to the accompanying drawings.

Figure 1:
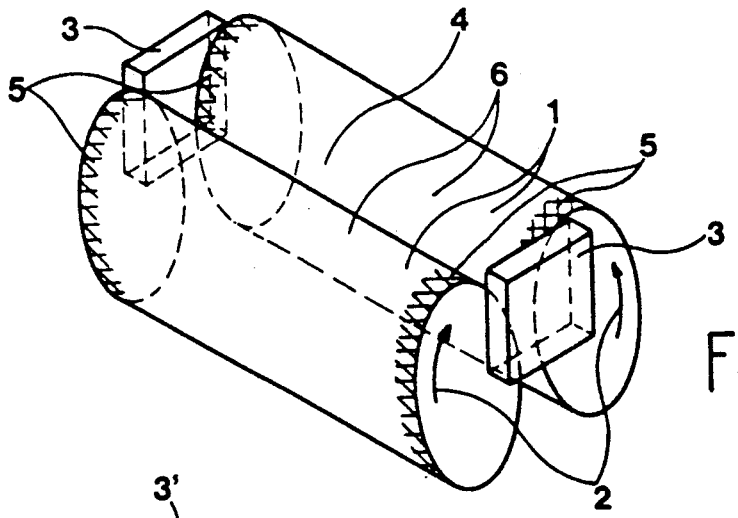
FIG. 1 is a diagrammatic view of a device for casting between two rolls according to the invention.

FIG. 1 is a diagrammatic representation of an installation for casting between two rolls, this installation comprising two rolls 1 driven in rotation in the direction of arrows 2 and two fixed side walls or dams 3 disposed against the ends of the rolls 1 for closing a casting space 4 into which molten metal is poured in the course of the casting.

The cylindrical wall of the rolls 1 is cooled and, as is well known, the molten metal poured into the casting space 4 solidifies or freezes upon contact with these cooled walls and forms skins of solidified metal which progressively increase in thickness and join up in the region of the plane containing the axes of the rolls 1 and make up the product cast in the form of a thin strip or band which is continuously extracted from below.

According to the invention, the surface of the walls of the rolls 1 include in proximity to each of the side walls 3 circumferential zones 5 represented by the cross-hatching whose roughness is greater than the roughness of the median zone 6.

As an example, for a width of the casting surface of 800 mm, the width of the roughest zones 5 is about 10 mm, the roughness Rz of said zones 5 being 150 μm and the roughness of the median zone 6 being 80 μm. However, these values may vary to a relatively great extent depending upon the dimensions of the rolls, the nature of the casting surface and that of the cast metal. Preferably, the roughness Rz of the roughest zones 5 will be substantially equal to or greater than double the roughness of the less rough zones.

Such roughnesses may be imparted to the casting surface by many processes such as knurling shot-blasting, electroerosion, hammering, etc.

The type or the shape of the roughnesses will depend essentially on the process chosen. For example in the case of a roughness produced by knurling, there may be formed a roughness of the cross-knurling type as shown in FIG. 1, or a straight transverse knurling forming grooves extending in a direction parallel to the axis of the rolls, as shown in FIG. 2.

Moreover, the roughness of the different zones could be produced by different processes.

In the embodiment shown in FIG. 1 where the side walls 3 are placed against the ends of the rolls without having a projecting portion located between the rolls and in contact with the cylindrical surfaces of the latter, the highly rough zones 5 are located in direct proximity to the edges of the casting surfaces, i.e. at each end of the rolls.

Figure 2:
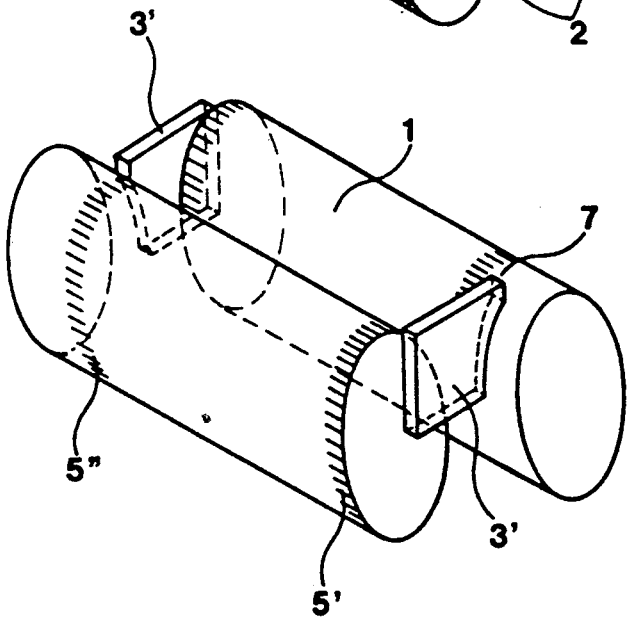
FIG. 2 is a view of an embodiment in the case of axially offset rolls.

FIG. 2 shows an embodiment of the device in which the rolls 1 are axially offset from each other, each side wall 3' bearing on one hand against the end face of a roll and on the other hand against the cylindrical wall of the other roll. This general configuration is already known to permit, by a relative displacement of the rolls in the axial direction, a variation in the width of the casting space and consequently a variation in the width of the thin strip cast.

In this case, each roll will comprise a zone 5' of great roughness on one edge of the casting surface, and another zone of great roughness at a certain distance from the other edge, this distance being defined in accordance with the distance between the side walls. The cylindrical zone 7 which is in contact with the side walls preferably has a roughness which is sufficiently slight to avoid risk of abrasion of the side wall in the course of the casting operation.

Figure 4:
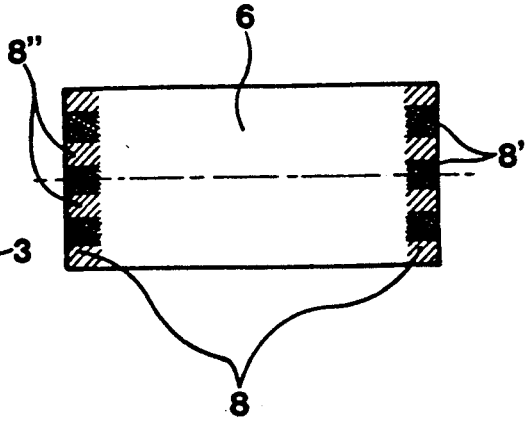
FIG. 4 is a top plan view of a roll having high roughness on the edges in a particular configuration of this roughness.

A roll such a that shown in plan in FIG. 4 may be employed instead of the rolls 1 in the device shown in FIG. 1. The rougher zones 8 of this type of roll have the particularity of being divided circumferentially into a plurality of segments 8', 8'' having alternately different roughnesses. For example, the segments 8' have great roughness greater than the roughness of the segments 8'' which may itself be equal to or greater than the roughness of the median zone 6.

This particular arrangement for example facilitates a possible trimming of the edge portions of the cast product obtained by the use of such rolls, by creating zones of preferential rupture of said edge portions.

It has indeed been found that sudden variations in the roughness of the surface of the rolls, such as those resulting from the alternation of the segments 8, 8', produce in the product, in the regions corresponding to these changes in the roughness, a weakening of the metal of the cast product which facilitates the subsequent trimming of the edge portions, for example by shearing.

It will already have been understood that the use of the rolls and devices just described with reference to FIGS. 1, 2 and 4 permits carrying out the process according to the first embodiment of the invention by encouraging, by means of a high roughness of the casting surfaces in proximity to the side walls, the driving along of the edge portions of the solidified metal skins.

Figure 3:
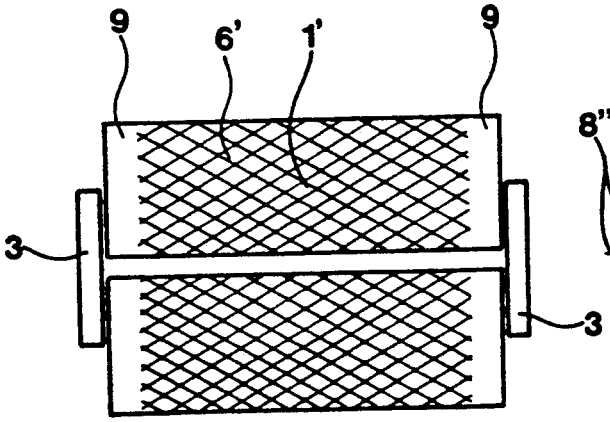
FIG. 3 is a top plan view of another device in the case of casting surfaces which are rougher in their median part than adjacent the edges.

The device shown in plan in FIG. 3 is adapted to carry out the second embodiment of the process. In this embodiment of the device, the rolls 1' comprise a median circumferential zone 6' of greater roughness than the circumferential zones 9 located in proximity to the side walls.

As already mentioned, the roughness of the zones 9 is sufficiently slight to permit a slipping of the edge portions of the skins solidified on these zones, in the event that said edge portions would have a tendency to be retained by attachment to the side walls. This slipping may moreover be facilitated by a lubrication of the zones 9 prior to casting o a regular lubrication in the course of the latter.

The roughness of the circumferential median zones 6' of the rolls 1' may of course be produced by the aforementioned processes.

The scope of the invention is not intended to be limited to the devices just described as examples. The invention could for example be applied to installations for casting on a single roll.

What is claimed is:

1. Device for casting thin metal products on a roll or between two rolls, said device comprising at least one roll for driving in rotation and including a cooled wall, and side walls defining with said at least one roll a casting space, said at least one roll having an outer surface which is divided into at least three circumferential rough zones, at least one of said zones a roughness greater than the roughness of the other zones, said at least one zone of greater roughness defining a means for preferentially driving a corresponding zone of a product engaged therewith, and wherein the roughness (Rz) of said at least one zone of greater roughness is at least twice the roughness (Rz) of said other zones.

2. Device according to claim 1, wherein said surface of said at least one roll comprises two rough zones each located in proximity to a respective one of said side walls, the roughness of said two rough zones being greater than the roughness of a third zone located between said two rough zones.

3. Device according to claim 1, wherein said surface of said at least one roll comprises at least one rough zone whose roughness is greater than the roughness of the other zones, said at least one rough zone being at a distance from said side walls.

4. Roll for a device for the continuous casting on a roll or between two rolls, said roll comprising a cylindrical casting surface which is divided into at least three circumferential rough zones, at least one of said zones a roughness which is greater than the roughness of the other zones, said at least one zone of greater roughness defining a means for preferentially driving a corresponding zone of a product engaged therewith, and wherein the roughness (Rz) of said at least one zone of greater roughness is at least twice the roughness (Rz) of said other zones.

5. Roll according to claim 4, comprising two zones of greater roughness located on edge portions of the casting surface.

6. Roll according to claim 5, wherein the roughness of the zones of greatest roughness is substantially at least twice the roughness of said other zones.

7. Roll according to claim 4, comprising a median zone and two other zones located on edge portions of said casting surface, said median zone having a greater roughness than said other zones.

8. Roll according to claim 4, wherein the roughness of the at least one zone of greater roughness is substantially at least twice the roughness of said other zones.

* * * * *